United States Patent [19]

Geffers et al.

[11] 4,143,910

[45] Mar. 13, 1979

[54] CHAIR HAVING SYNCHRONOUSLY COUPLED TILTABLE SEAT AND BACK REST

[76] Inventors: Klaus Geffers, Goethestr. 26; Fritz Drabert, Marienstr. 37, both of D-495 Minden, Fed. Rep. of Germany

[21] Appl. No.: 832,709

[22] Filed: Sep. 12, 1977

[51] Int. Cl.[2] ..... A47C 1/032

[52] U.S. Cl. ..... 297/301; 297/320

[58] Field of Search ..... 297/300-304, 297/320

[56] References Cited

U.S. PATENT DOCUMENTS

| | | | |
|---|---|---|---|
| 964,012 | 7/1910 | Folts | 297/302 |
| 2,163,751 | 6/1939 | Flint | 297/301 |
| 2,426,336 | 8/1947 | Binus | 297/304 X |
| 2,456,797 | 12/1948 | Sheldrick | 297/301 |
| 2,516,172 | 7/1950 | Baldwin | 297/302 X |
| 3,455,601 | 7/1969 | Lie | 297/301 |
| 3,602,537 | 8/1971 | Kerstholt et al. | 297/304 |

*Primary Examiner*—Francis K. Zugel

*Attorney, Agent, or Firm*—Pollock, Vande Sande and Priddy

[57] ABSTRACT

A chair having an adjusting device for synchronously coupling a tiltable back rest to a tiltable seat comprises a seat support, a seat pivotally connected to the seat support, a back rest support pivotally connected to the seat support, a linkage between the seat and back rest support for causing pivotal motion of the back rest support to effect related pivotal motion of the seat, and a stored power element such as a fluid spring connected between the seat support and back rest support and concealed within a back rest mounted on the back rest support.

4 Claims, 2 Drawing Figures

CHAIR HAVING SYNCHRONOUSLY COUPLED TILTABLE SEAT AND BACK REST

BACKGROUND OF THE INVENTION

The present invention relates to an article of furniture, particularly a chair, comprising a tiltable seat associated with a reclining back rest, which includes an adjusting device including a stored power source for restoring the seat and back rest from a reclining to a normal position, and in which the several elements are so arranged that the change in inclination of the seat and back rest are synchronously coupled to one another. The term "chair", as used hereinafter, is intended to encompass all such articles of furniture.

Various designs of chairs having adjusting devices for synchronously coupling the seat and back rest are already known in the art. These designs usually include one or more stored power elements which hold the back rest and seat at a fixed starting position under no load conditions, and which restore the back rest and seat to this starting position after an applied force, e.g. due to movement of the upper body of a user, is removed. Compression, tension, and so-called "fluid" springs have been used as such stored power elements and, in the known arrangements, are usually placed horizontally under the seat of the chair.

One disadvantage of the above arrangement is that, due to unfavorable leverage ratios, the back rest tends to follow the movement of the upper body of the user in a faltering manner when a person sitting on the chair moves forwardly to relieve the force being applied to the back rest. This results from the fact that the weight of the user's body continues to apply a load to the seat, which is synchronously coupled to the back rest, during such movement. In some prior designs, it is even necessary for the user to rise from the seat in order to allow the seat and back rest to be brought forward by the stored power element. In contrast, one object of the present invention is to provide a chair, of the type having synchronously coupled seat and back rest portions, wherein the back rest follows more smoothly the movements of the upper body of the user, and wherein the back rest and seat can return without delay to their original no-load positions.

Other designs of chairs have been suggested which provide the smoother flow of motion achieved by the present invention, and achieve this result by a more favorable selection of leverage ratios. However in these other designs, the stored power elements must be arranged parallel to the upright part of the chair, and open to view, or at such a great distance below the seat that the stored power elements are always visible in an annoying and unattractive manner. In contrast, another object of this invention is to provide a chair which exhibits such more favorable leverage ratios but wherein the stored power element is not open to view, resulting in a more esthetically pleasing design.

SUMMARY OF THE INVENTION

The present invention overcomes the disadvantages of the prior art designs by placing the stored power element between the front and back surfaces of the back rest, preferably in a substantially vertical position, concealed from view within the back rest between the forward surface of the back rest and a rear covering on the back rest. This arrangement, in addition to achieving an esthetic improvement, permits selection of leverage ratios in such an advantageous manner that the back rest and synchronously coupled seat will follow the motion of the upper body of the user smoothly and without any delay.

The back rest is preferably mounted on a back rest support which is hinged to a seat support in such member that the back rest may swivel about a horizontal axis. Another swivel mounted element connecting the back rest support and seat support provides for adjustment of the seat inclination as the back rest is moved. The stored power element is hingedly connected at one end to the seat support and at its other end to the back rest support.

The stored power element, preferably taking the form of a fluid spring, is made easily accessible for purposes of chair assembly, or for purposes of repair when necessary, by use of a detachable cover on the back rest taking the form of either a detachable full-size rear cover, or an access panel which is detachably inserted into the rear cover of the back rest.

DESCRIPTION OF THE PREFERRED EMBODIMENT

Figure 1:
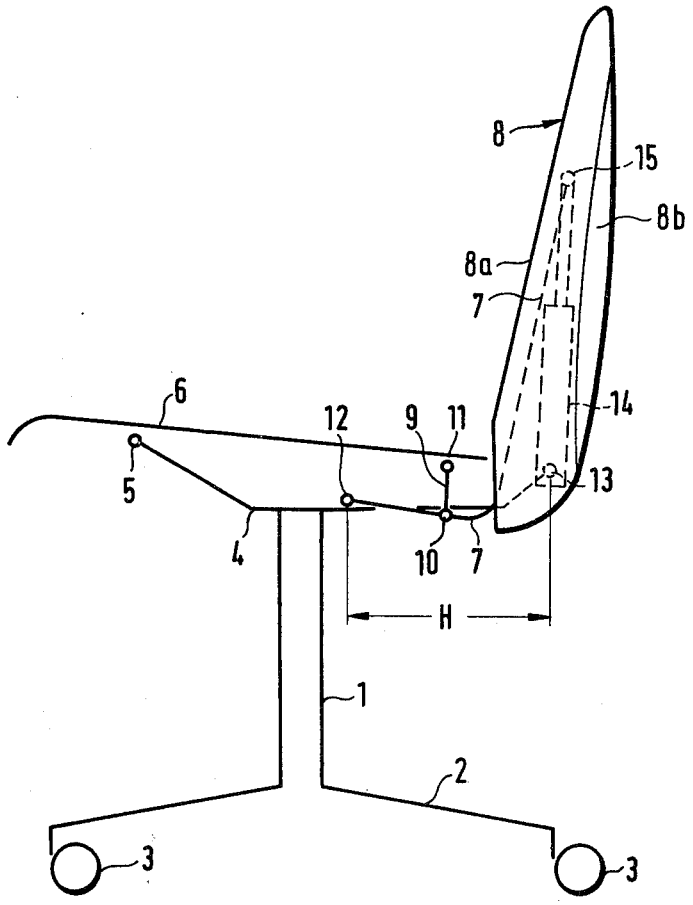
FIG. 1 is a diagrammatic side view of a chair, constructed in accordance with the present invention, in its no-load position.

Referring to FIG. 1, the chair of the present invention preferably includes a center chair column 1 the lower end of which is connected to a pedestal 2 having wheels, rollers, or casters 3 which are swivel mounted at the ends of the pedestal 2. A seat support 4 is attached to the top of chair column 1. The front edge of seat support 4 carries a bearing 5 to which a seat 6 is swivel mounted. Seat support 4 extends rearward of the rear edge of seat 6.

A substantially L-shaped back rest support 7 includes a lower first leg which extends below the seat 6 in a substantially horizontal direction, and a longer second leg which extends in a generally vertical direction rearward of the rear edge of seat 6. This second, general vertical leg of back rest support 7 is located within a back rest 8, the back rest 8 being attached to the back rest support 7 either rigidly or removably. Back rest 8 comprises a front cover **8*a*, and a detachable rear cover 8*b***.

A fulcrum or hinge point 10, is provided in an intermediate region of the lower first leg of back rest support 7 and a further fulcrum or hinge point 11 is provided beneath and adjacent the rear edge of seat 6. A generally vertical connecting element or link 9 extends through an open region in seat support 4 and is hingedly connected at its opposing ends to the two fulcrums 10 and 11 respectively. The forwardmost end of back rest support 7 passes through an open region in seat support 4 and is pivotally attached to the seat support 4 at a hinge point 12 in such a manner that the back rest support 7 can pivot vertically about its front horizontal swivel axis 12, relative to seat support 4.

An additional fulcrum or hinge pivot 13 is provided at the rear edge of seat support 4, and the lower end of a stored power element 14 is pivotally connected to said hinge point 13. In the preferred embodiment of the invention a fluid spring is used as the stored power element 14, but other types of stored power elements may be utilized. The upper end of the spring 14 is hingedly connected to the upper end of the back rest support 7 at a still further fulcrum or hinge point 15. The upper leg of back rest support 7, as well as the fluid spring 14 and the fulcrum 13 are all located inside the back rest 8 between its front cover 8*a* and removable rear cover 8*b*, and thereby concealed from view.

Figure 2:
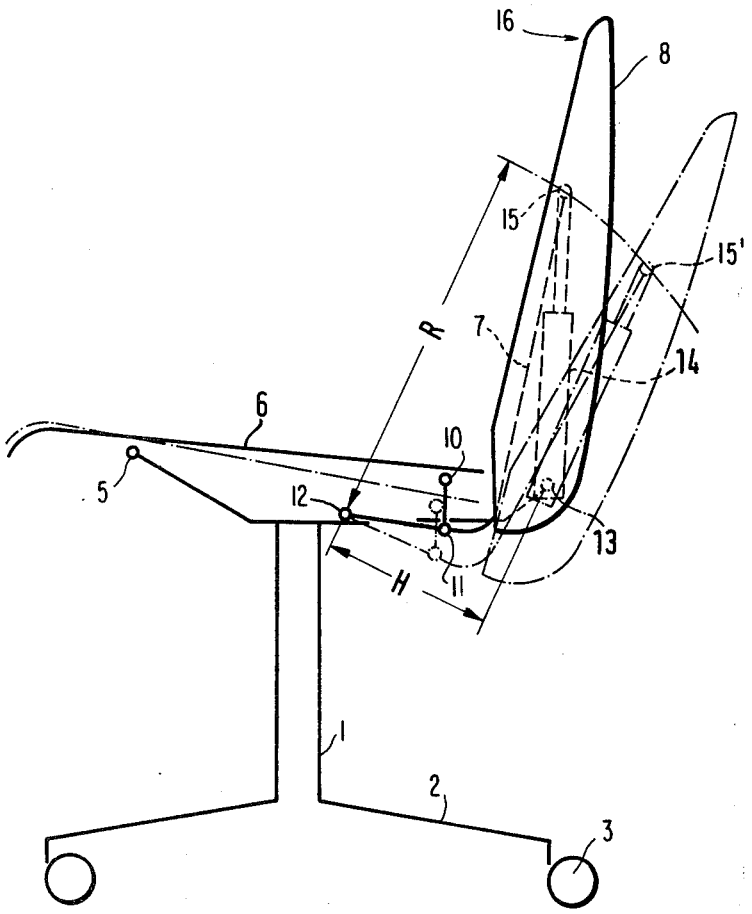
FIG. 2 is a diagrammatic side view of the chair of FIG. 1 illustrating its operation.

Referring now to FIG. 2, if the back rest 8 is pushed in the direction shown by arrow 16, the back rest support 7 will pivot as an entity about the swivel axis 12 (as shown in broken lines) causing the fulcrum 15 to travel over an arc of radius R between its no-load position (shown in full line) and a predetermined end position 15'. At the same time the fluid spring 14 pivots about the fulcrum or hinge point 13 at its lower end and, due to the illustrated geometry, is compressed by this action so that the restoring force of the spring 14 is increased. Moreover, since the rearward pivoting action of back rest 8 causes a lowering of the lower leg of back rest support 7, as illustrated, the connecting element 9 joining the back rest support 7 and seat 6 between hinge points 10 and 11, simultaneously causes the seat 6 to pivot about bearing 5 whereby the inclination of seat 6 is automatically adjusted downwardly during the rearward movement of the back rest 8.

When the pressure or force in the direction of the arrow 16 is relieved, the back rest 8 immediately and smoothly follows the forward movement of the upper body of the user of the chair, and back rest 8 and seat 6 are returned synchronously toward their respective starting positions. The return action is immediate and smooth due primarily to the long lever arm H which is provided between the axis of rotation 12 of the back rest support 7.

If desired, means may be provided for permitting the reclinable back rest 8 to be selectively fixed in position at any one of a plurality of intermediate positions between the opposite ends of the arc defined by points 15 and 15'.

The present invention may be embodied in other specific forms without departing from the spirit or essential characteristics thereof. The presently disclosed embodiment is therefore to be considered in all respects as illustrative and not restrictive, the scope of the invention being indicated by the appended claims rather than by the foregoing description, and all changes which come within the meaning and range of equivalency of the claims are intended to be enbraced therein.

Having thus described our invention, we claim:

1. A chair comprising a seat support, a seat pivotally connected to said seat support at a first hinge point located adjacent the forward edge of said seat, a back rest support pivotably connected to said seat support at a second hinge point spaced from said first hinge point, linkage means between said seat and said back rest support operative to cause pivotal motion of said back rest support about said second hinge point to effect related pivotal motion of said seat about said first hinge point, a third hinge point adjacent the rear end of said seat support, said linkage means comprising a generally vertical connecting element having its upper end pivotally connected to said seat adjacent the rear edge of said seat and having its lower end pivotally connected to said back rest support at a location between said second and third hinge points, a fourth hinge point located on said back rest support above said third hinge point, said back rest support being substantially L-shaped and comprising a generally horizontal leg and a generally vertical leg, the free end of said generally horizontal leg being pivotally attached to said second hinge point at a location rearward of said first hinge point and forward of said third hinge point, said fourth hinge point being located near the free end of said generally vertical leg, an elongated stored power element extending in a generally vertical direction and having a pair of opposing ends which are connected to said third and fourth hinge points respectively, and a back rest mounted on said back rest support, said back rest including a rear cover, said stored power element being concealed within said back rest between its forwardmost surface and said rear cover.

2. The structure of claim 1 wherein said rear cover is detachable from said back rest to facilitate access to said stored power element.

3. The structure of claim 1 wherein said stored power element is a fluid spring.

4. The structure of claim 1 wherein said generally vertical leg, said stored power element, and said third and fourth hinge points, are all concealed within said back rest between the forward and rearward surfaces of said back rest.

* * * * *